US011897679B2

(12) United States Patent
Slovik et al.

(10) Patent No.: US 11,897,679 B2
(45) Date of Patent: Feb. 13, 2024

(54) CONTAINER CARRIER

(71) Applicant: ILLINOIS TOOL WORKS INC., Glenview, IL (US)

(72) Inventors: Rachell L. Slovik, Bartlett, IL (US); Patrick R. Van Tholen, Lombard, IL (US); Robert C. Olsen, Medinah, IL (US); Christopher J. Samaras, Tinley Park, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/375,844

(22) Filed: Jul. 14, 2021

(65) Prior Publication Data

US 2022/0017278 A1 Jan. 20, 2022

Related U.S. Application Data

(60) Provisional application No. 63/052,064, filed on Jul. 15, 2020.

(51) Int. Cl.

| | |
|---|---|
| ***B65D 71/50*** | (2006.01) |
| ***B65D 27/04*** | (2006.01) |
| ***B65B 27/04*** | (2006.01) |
| ***B65B 69/00*** | (2006.01) |

(52) U.S. Cl.
CPC ..... *B65D 71/504* (2013.01); *B65B 27/04* (2013.01); *B65B 69/00* (2013.01)

(58) Field of Classification Search
CPC ..... B65D 71/504; B65B 27/04; B65B 69/00
USPC ..... 53/396
See application file for complete search history.

(56) References Cited

U.S. PATENT DOCUMENTS 3,086,651 A * 4/1963 Ougljesa ..... B65D 71/504 294/87.2
3,664,497 A * 5/1972 Mascia ..... B65D 17/4012 211/74
3,778,096 A 12/1973 Smith
3,784,002 A * 1/1974 Owen ..... B65D 71/50 294/87.2
4,103,811 A * 8/1978 Owen ..... B65D 71/504 206/150
4,149,631 A 4/1979 Cunningham
(Continued)

OTHER PUBLICATIONS

EPO, English language version of the International Search Report, Form PCT/ISA/210 for International Application PCT/US2021/041747, dated Oct. 27, 2021 (5 pages).
(Continued)

*Primary Examiner* — Robert F Long
*Assistant Examiner* — Xavier A Madison
(74) *Attorney, Agent, or Firm* — Pauley Erickson & Swanson

(57) ABSTRACT

A flexible container carrier and related method for unitizing a plurality of containers that includes a plurality of flexible bands forming an array of container receiving apertures, the array arranged in longitudinal rows and transverse ranks. A series of frangible lines of separation are provided between each container receiving opening so that removing a container from the package results in the separation of the frangible lines of separation defining the respective container receiving opening and thus the container and a respective band of the plurality of bands are removed from the package together.

15 Claims, 4 Drawing Sheets

(56) References Cited

U.S. PATENT DOCUMENTS 5,072,829 A * 12/1991 Marco ..... B65D 71/504
206/428
5,211,711 A * 5/1993 Marco ..... B26D 3/12
83/862
5,265,718 A 11/1993 Marco

OTHER PUBLICATIONS

EPO, English language version of the Written Opinion of the ISA, Form PCT/ISA/237 for International Application PCT/US2021/041747, dated Oct. 27, 2021 (9 pages).

* cited by examiner

CONTAINER CARRIER

CROSS REFERENCE TO RELATED APPLICATION

This application claims the benefit of U.S. Provisional Application, Ser. No. 63/052,064, filed on 15 Jul. 2020. This U.S. Provisional Application is hereby incorporated by reference herein in its entirety and are made a part hereof, including but not limited to those portions which specifically appear hereinafter.

BACKGROUND OF THE INVENTION

Field of the Invention

This invention relates to a container carrier having container receiving apertures for unitizing a plurality of containers in a zero waste package.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures, typically of an oval, round or rectangular configuration, that each engage a corresponding container may be used to unitize groups of four, six, eight, twelve or other suitable groups of containers into a convenient multipackage. Flexible ring carriers may include a handle that extends upwardly from the carrier to enable a consumer to carry the package from the top (called a "top lift carrier") or outwardly from a side of the carrier to enable a consumer to carry the package from the side (called a "side lift carrier").

There are benefits associated with reducing waste associated with multipackages. A carrier that "disappears" following use is advantageous from a waste stream perspective. However, such a carrier must also withstand the rigors of high speed application to containers. As such, a need arises for a reduced-weight, zero waste carrier capable of carrying a large number of containers that permits high speed application and results in an aesthetically pleasing package for the consumer to handle.

SUMMARY OF THE INVENTION

The present invention relates to a flexible carrier for packaging containers that includes an arrangement of container receiving apertures that are configured to permit placement over containers and optionally permit carrying a unitized package of containers along a handle extending longitudinally along the package. The carrier is suitably configured with a combination of webs and container receiving apertures that permit opening up and generally even, distributed stretching for high-speed application to the containers.

The subject invention is directed to a container carrier that includes an arrangement of container receiving apertures divided by a series of frangible lines of separation as shown in the attached drawings. The resulting carrier is configured to enable placement over corresponding containers in a tight, unitized bricklike package and subsequent individual removal of both a container and a portion of the container carrier attached to that container by applying either a torque or straight line force parallel or perpendicular to the package construction. The removal force type and direction can be designed into the product by the location and orientation of the perforation patterns used.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 6:
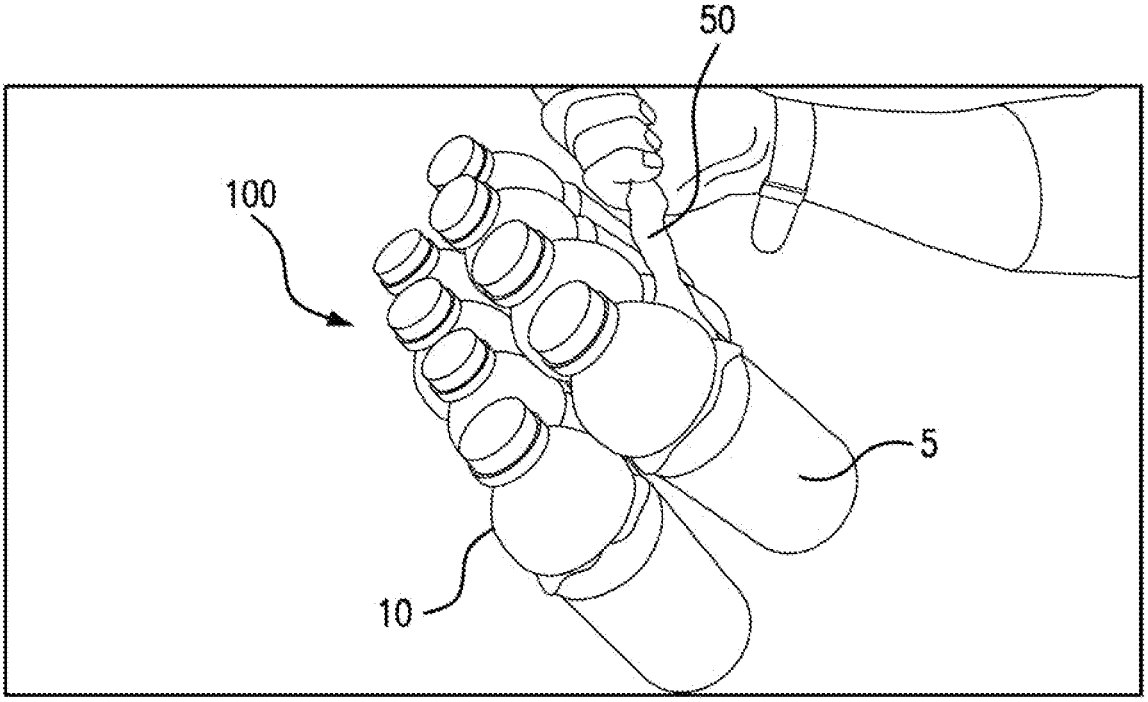
FIG. 6 is a front view of a multipackage of containers according to one preferred embodiment of this invention.
Figure 7:
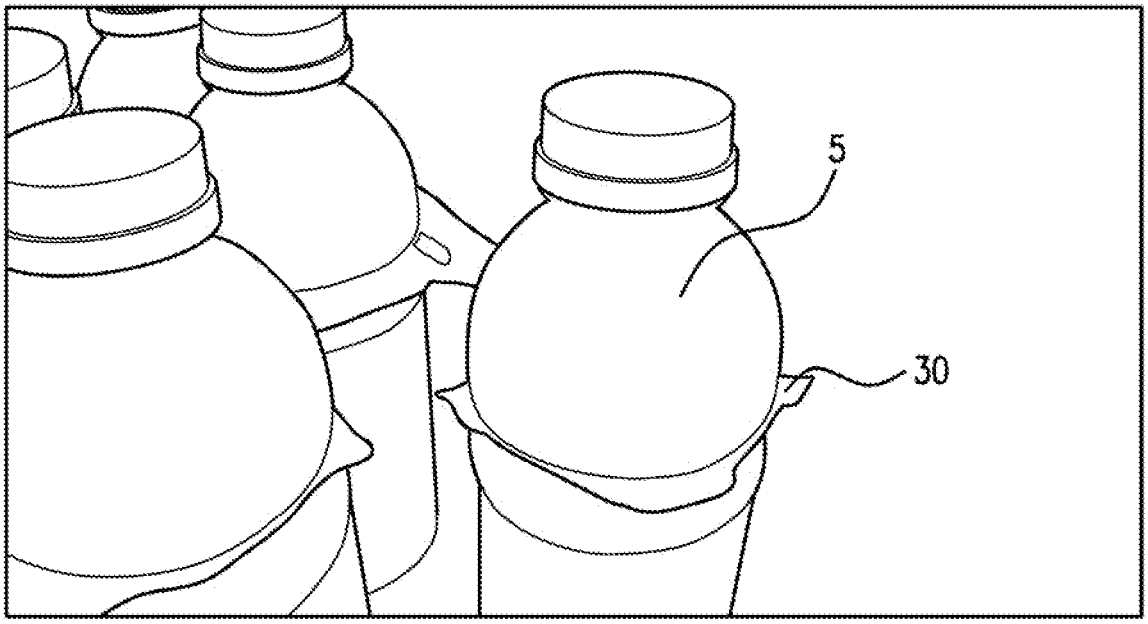
FIG. 7 is a front view of a multipackage of containers according to one preferred embodiment of this invention.
Figure 8:
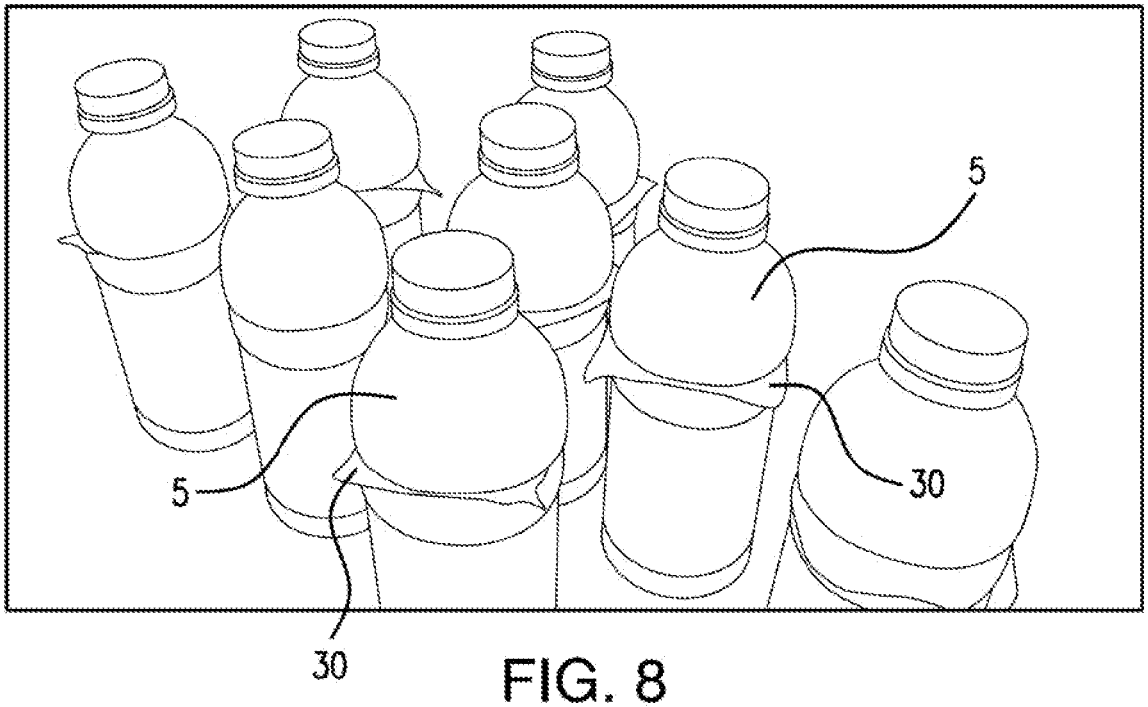
FIG. 8 is a front view of a multipackage of containers according to one preferred embodiment of this invention.

FIGS. 1-5 show a flexible carrier 10 for unitizing multiple containers 5 into a resulting unitized multipackage 100. FIGS. 6-8 show an embodiment of a multipackage 100 of containers 5. Although FIGS. 1-8 illustrate various structures for flexible carrier 10 of the invention, the illustrations are exemplary, and the invention is not limited to the flexible carriers 10 or multipackages 100 shown for six or eight containers. For example, flexible carrier 10 may be alternatively configured and used to unitize four, ten, twelve, or any other desired number of containers.

Containers 5 are preferably PET bottles as shown in FIGS. 6-8, however cans, glass bottles or any other commonly unitized container may be used with the flexible carrier according to this invention. The containers 5 are preferably, though not necessarily, like-sized within a single flexible carrier 10.

Figure 1:
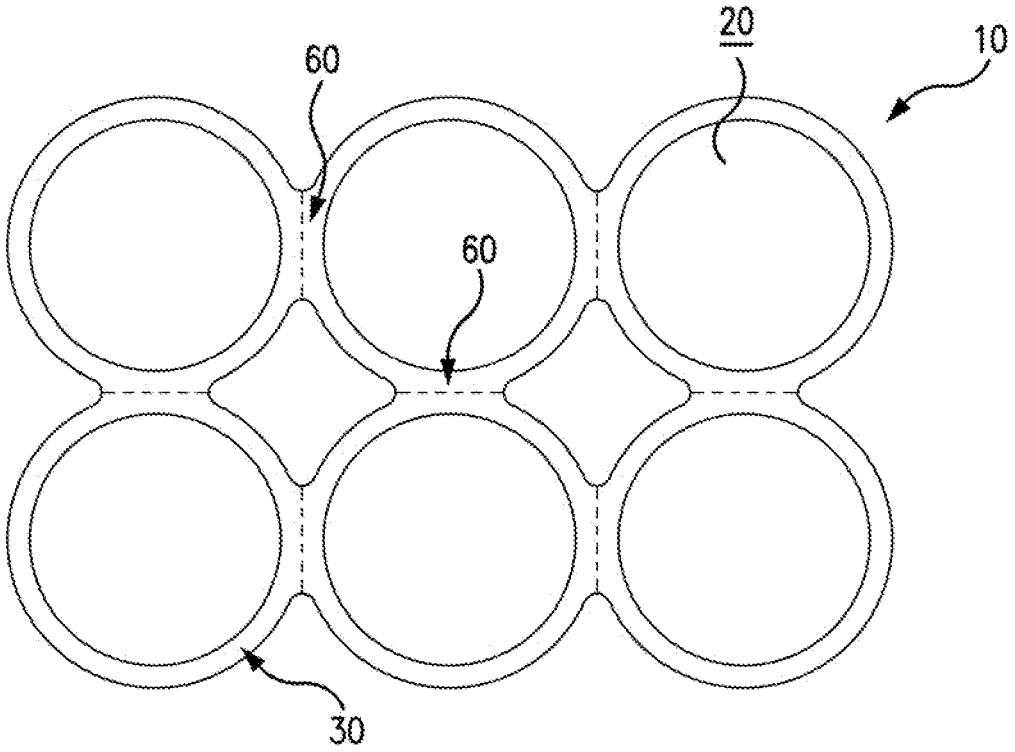
FIG. 1 is a side elevational view of a container carrier according to one preferred embodiment of this invention.
Figure 2:
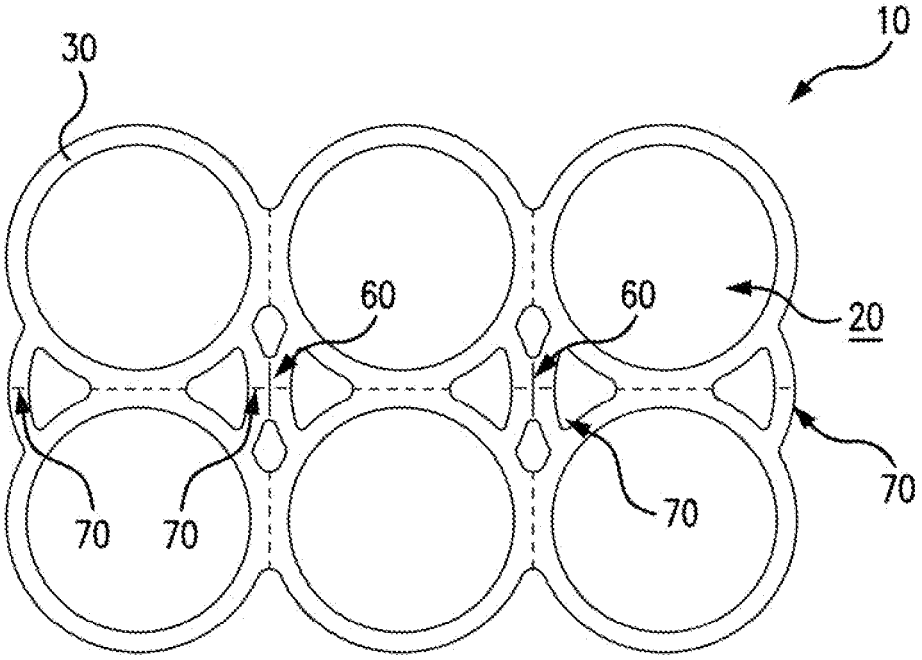
FIG. 2 is a side elevational view of a container carrier according to one preferred embodiment of this invention.
Figure 3:
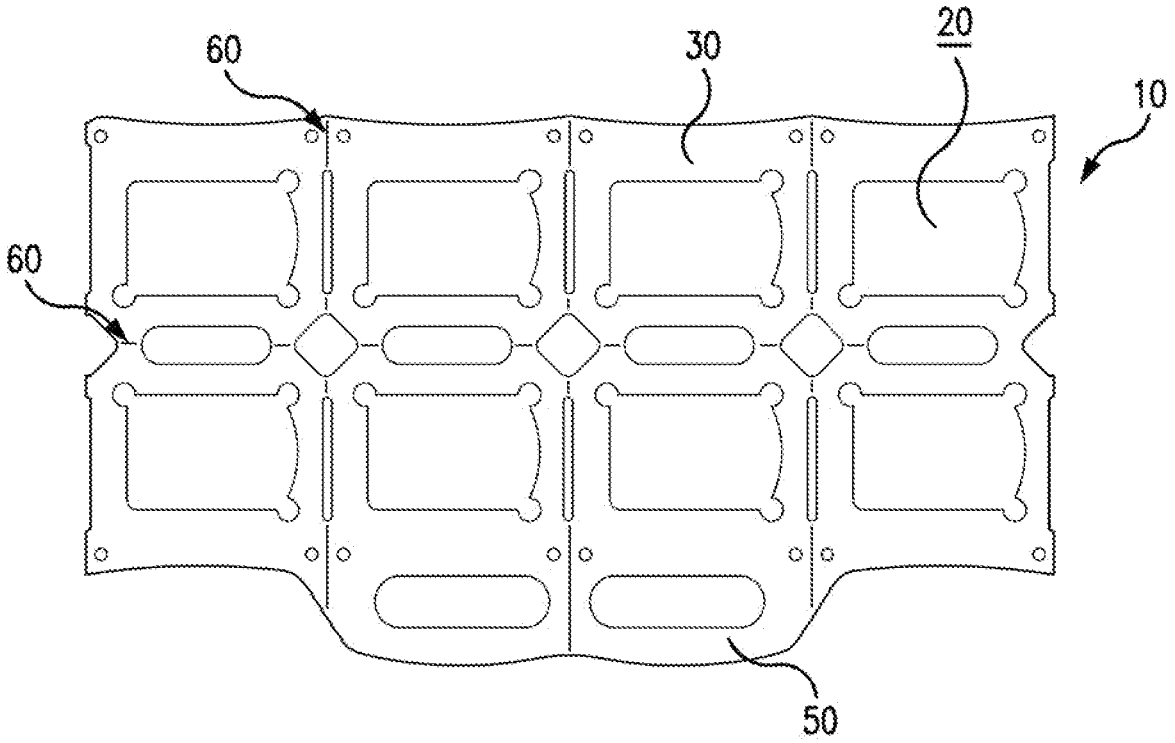
FIG. 3 is a side elevational view of a container carrier according to one preferred embodiment of this invention.
Figure 4:
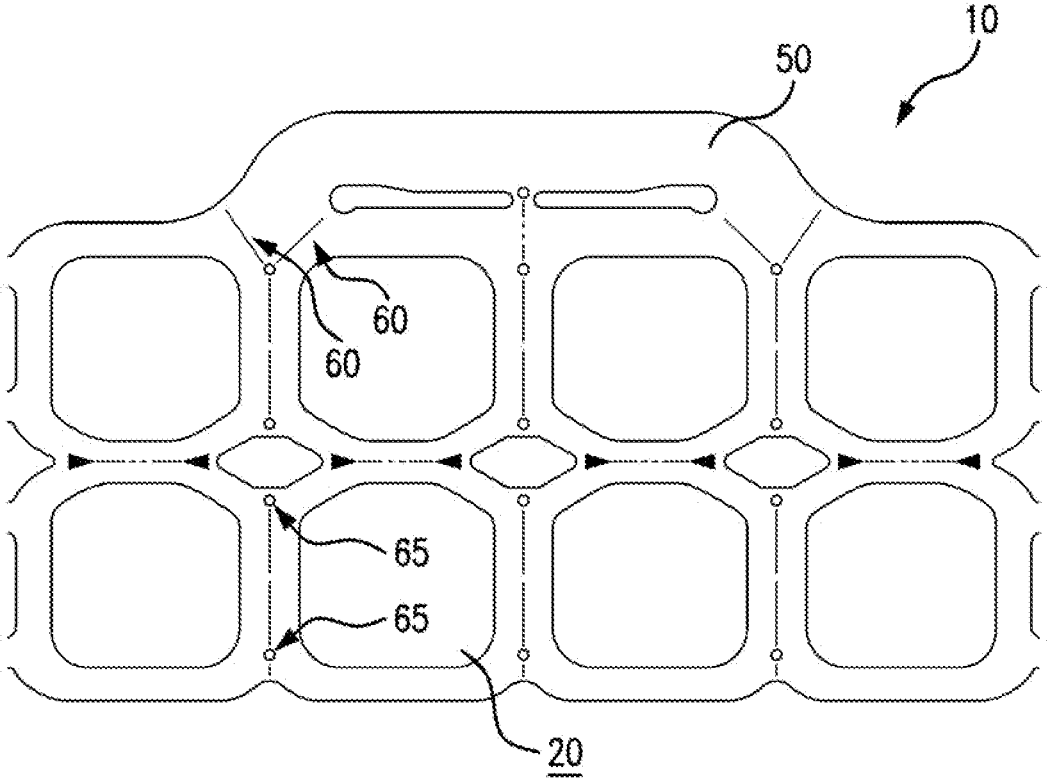
FIG. 4 is a side elevational view of a container carrier according to one preferred embodiment of this invention.

Each flexible carrier 10 preferably includes a single layer of flexible sheet having a width and length defining therein a plurality of flexible bands 30 further defining a plurality container receiving apertures 20, each for receiving a container. The plurality of container receiving apertures 20 are preferably arranged in two longitudinal rows and multiple longitudinal ranks so as to form an array of container receiving apertures 20, such as two rows by three ranks for a six container multipackage 100 as shown in FIGS. 1 and 2 or two rows by four ranks for an eight container multipackage 100 as shown in FIGS. 3 and 4. Container receiving apertures 20 may be circular as shown in FIGS. 1 and 2, generally square as shown in FIG. 4, or slightly elongated in a longitudinal direction of flexible carrier 10, as shown in FIG. 3.

A representative multipackage 100 resulting from the flexible carrier 10 includes a plurality of unitized containers 5, such as shown in FIG. 6. The flexible carriers 10 are generally applied to containers 5 by stretching the flexible bands 30 surrounding the container receiving apertures 20 around each container 5, and requiring the stretched carrier 10 to recover, thereby providing a tight engagement.

A preferred carrier configuration includes bands 30 forming two distinct parallel rows of container receiving apertures 20. Each rank preferably includes two container receiving apertures 20 (one for each row in the carrier). Preferably, each of the carriers 10 shown in FIGS. 1-5 are manufactured in a generally continuous string of carriers wherein the carriers 10 are punched or otherwise formed longitudinally adjacent to other carriers 10. In this manner, a generally continuous string of carriers 10 is formed that may be rolled onto reels or folded into boxes for later unwinding and application to containers 5. The carriers 10 are then cut into individual carriers 10 and formed into individual multipackages 100.

Container receiving apertures 20 are preferably formed by the bands 30 in a geometry that results in a uniform application of the carrier 10 to containers 5 to produce a tight unitization of containers 5 within each flexible carrier 10. Such a result is difficult when material within the flexible carrier 10 is minimized as shown and described herein.

As shown in FIGS. 3, 4 and 6, a handle 50 extends from a longitudinal edge of the carrier 10. The handle 50 may comprise one or more elongated apertures positioned along the outer periphery of the handle 50 or may comprise a similar configuration that provides an ample area for a consumer to grasp by inserting a hand through and still maintain the purpose and integrity of the multipackage 100.

A flexible container carrier for unitizing a plurality of containers according to a preferred embodiment of this invention preferably includes the plurality of bands 30 defining a corresponding plurality of container receiving openings, wherein each container of the plurality of containers is positioned in a respective container receiving opening. A series of frangible lines of separation 60 are thereupon aligned between each container receiving opening, wherein the frangible lines of separation 60 are adapted to remove a respective band 30 of the plurality of bands when a corresponding container 5 is removed. The frangible lines of separation 60 may comprise a perforation, a series of slits or other weakened area that permits separation of a portion of the carrier 10 from the remaining carrier 10.

In one embodiment shown in FIGS. 1-3, a longitudinal and a transverse frangible line of separation 60 are positioned relative to each and every container receiving opening 20. In this manner, each container receiving opening 20 includes a tearaway line of separation 60 to permit removal of the band portion together with the container. A user may apply either a torque or straight line force parallel or perpendicular to the package construction for removal of both the container and the band portion. The removal force type and direction can be designed into the product by the location and orientation of the perforation patterns used.

FIG. 2 shows one embodiment comprising at least two finger loops 70 positioned relative to the plurality of bands 30. In this preferred arrangement, at least one finger loop 70 is configured to sever upon removal of a proximate container from the package. Specifically, the finger loop 70 may include a line of separation 60 or a perforation dividing the finger loop 70 such that when a force of removal of the container is applied the finger loop 70 severs and thereby permits a band 30 corresponding with the removed container to be removed simultaneously and still affixed to the container.

As shown in FIG. 8, following removal of each container from the multipackage 100, no separate carrier portion remains apart from those portions fixed to respective containers.

Figure 5:
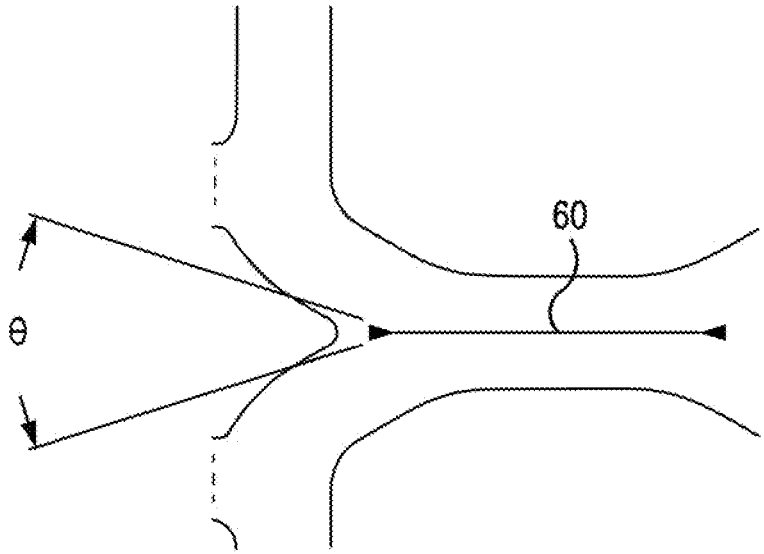
FIG. 5 is a magnification of a section of the container carrier shown in FIG. 4.

In particular, the frangible lines of separation 60 may comprise a plurality of closely spaced perforations that extend laterally relative to a longitudinal direction, as best shown in detail in FIG. 5. Such a plurality of closely spaced perforations may be graduated longer toward each end of each aperture, as shown in FIG. 5. Such perforations may get larger toward each edge of the lines of separation 60 to form an angle θ. Further, as shown in FIG. 4, one or more openings 65 may be placed at one or both ends of each line of separation 60

A corresponding method for packaging a plurality of containers in a flexible container includes providing a flexible carrier having a plurality of bands defining a corresponding plurality of container receiving openings, wherein each container of the plurality of containers is positioned in a respective container receiving opening; providing a series of frangible lines of separation between each container receiving opening; and removing a container from the package resulting in the separation of the frangible lines of separation defining the respective container receiving opening, wherein the container and a respective band of the plurality of bands are removed from the package together.

Each container receiving opening is preferably dividable from the package with both a longitudinal and a transverse frangible line of separation, such as shown in FIGS. 1 and 2.

While in the foregoing specification this invention has been described in relation to certain preferred embodiments thereof, and many details have been set forth for purpose of illustration, it will be apparent to those skilled in the art that flexible carrier 10 and multipackage 100 susceptible to additional embodiments and that certain of the details described herein can be varied considerably without departing from the basic principles of the invention.

What is claimed is:

1. A method for packaging a plurality of containers in a flexible container, the method comprising:

providing a flexible carrier having a plurality of bands defining a corresponding plurality of container receiving openings, wherein each container of the plurality of containers is positioned in a respective container receiving opening;

providing a series of frangible lines of separation between each container receiving opening, wherein each receiving opening includes a longitudinal frangible line of separation and a transverse frangible line of separation, wherein the longitudinal frangible line of separation comprises a plurality of closely spaced perforations that extend laterally relative to a longitudinal direction of the carrier and laterally relative to the line of separation and wherein the closely spaced perforations are graduated longer toward each end of each aperture; and removing a container from the package resulting in the separation of the frangible lines of separation defining the respective container receiving opening, wherein the container and a respective band of the plurality of bands are removed from the package together.

2. The method of claim 1 wherein each container receiving opening is dividable from the package with a longitudinal and a transverse frangible line of separation.

3. The method of claim 1 further comprising positioning at least two finger loops relative to the plurality of bands.

4. The method of claim 3 wherein at least one finger loop is severed upon removal of a proximate container from the package.

5. The method of claim 1 further comprising providing an integral handle with the plurality of bands.

6. The method of claim 1 wherein removal of six containers results in no remaining separate carrier portion.

7. The method of claim 1 further comprising twisting the container to remove both the container and the respective band from the package.

8. The method of claim 1 further comprising pulling the container downwardly to remove both the container and the respective band from the package.

9. A flexible container carrier for unitizing a plurality of containers comprising:

a plurality of bands defining a corresponding plurality of container receiving openings, wherein each container of the plurality of containers is positioned in a respective container receiving opening;

a series of frangible lines of separation between each container receiving opening, wherein each container receiving opening includes a longitudinal frangible line of separation and a transverse frangible line of separation, wherein the longitudinal frangible line of separation comprises a plurality of closely spaced perforations that extend laterally relative to a longitudinal direction of the carrier and laterally relative to the line of separation and wherein the closely spaced perforations are graduated longer toward each end of each aperture;

wherein the frangible lines of separation are adapted to remove a respective band of the plurality of bands when a corresponding container is removed.

10. The flexible carrier of claim 9 further comprising at least one of a handle and a panel formed adjacent the array of container receiving apertures.

11. The flexible carrier of claim 9 further comprising at least two finger loops positioned relative to the plurality of bands.

12. The flexible carrier of claim 11 wherein at least one finger loop is configured to sever upon removal of a proximate container from the package.

13. The flexible carrier of claim 9 further comprising an integral handle formed relative to the plurality of bands.

14. The flexible carrier of claim 9 wherein removal of six containers results in no remaining separate carrier portion.

15. The flexible carrier of claim 9 further comprising a plurality of adjacent carriers formed in a generally continuous string.

* * * * *